United States Patent [19]

Welsh

[11] Patent Number: 5,066,250

[45] Date of Patent: Nov. 19, 1991

[54] POLARIZING KEY PERMITTING CONNECTOR DISPLACEMENT

[75] Inventor: David E. Welsh, Tustin, Calif.

[73] Assignee: ITT Corporation, New York, N.Y.

[21] Appl. No.: 605,445

[22] Filed: Dec. 21, 1990

[51] Int. Cl.[5] ..... H01R 13/64

[52] U.S. Cl. ..... 439/681

[58] Field of Search ..... 439/677, 678, 679, 680, 439/681, 633

[56] References Cited

U.S. PATENT DOCUMENTS

| | | | |
|---|---|---|---|
| 977,836 | 12/1910 | Platt | 439/678 |
| 3,491,330 | 1/1970 | Barnhart et al. | 439/681 |
| 3,611,272 | 10/1971 | Fairbain | 439/681 |
| 4,778,411 | 10/1988 | Rudy, Jr. et al. | 439/681 |

*Primary Examiner*—Larry I. Schwartz
*Assistant Examiner*—Hien D. Vu
*Attorney, Agent, or Firm*—Thomas L. Peterson

[57] ABSTRACT

Polarizing keys are provided to allow only selected pairs of connectors to be mated, which allow one connector to be displaced slightly after mating, while also providing a large area of interference between nonmating keys to prevent their connectors from mating. Each key has an elongated keying portion with an interfitting side 94 (Fig. 9) which lies opposite the interfitting side of a similar corresponding key when the connectors are mated. Each interfitting side has forward and rearward parts 120, 122, with the rearward part 122 being indented with respect to the forward part.

6 Claims, 4 Drawing Sheets

FIG. 1
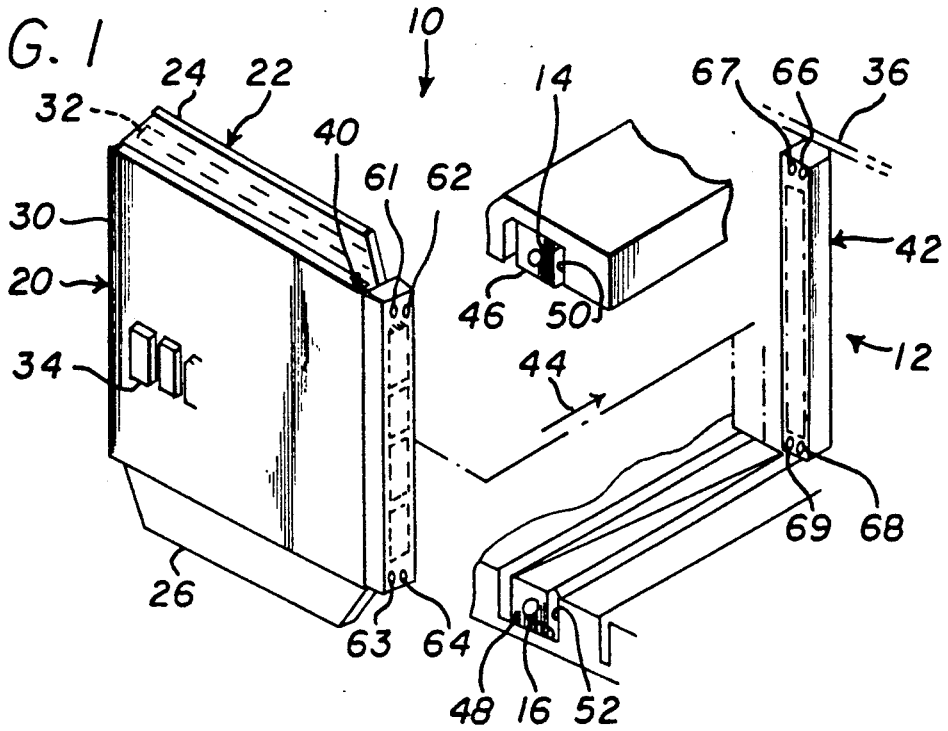
FIG. 2
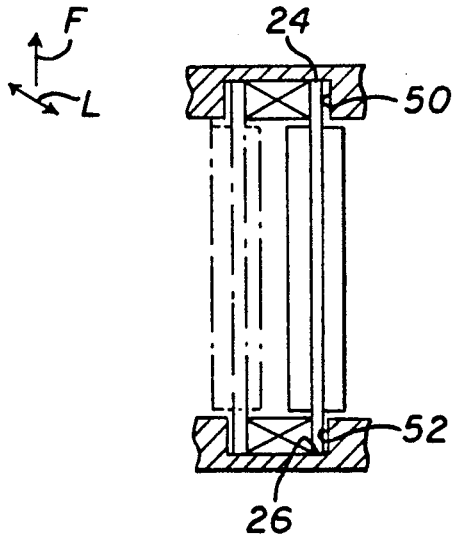
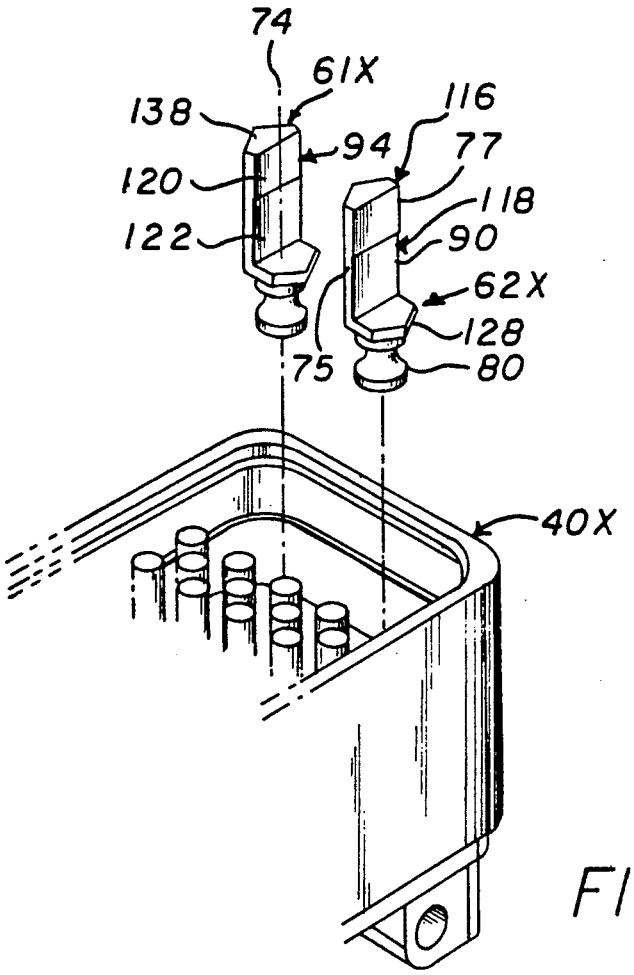
FIG. 9

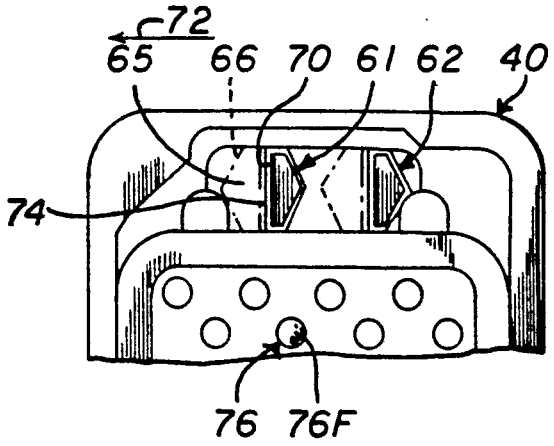
FIG. 3
FIG. 4
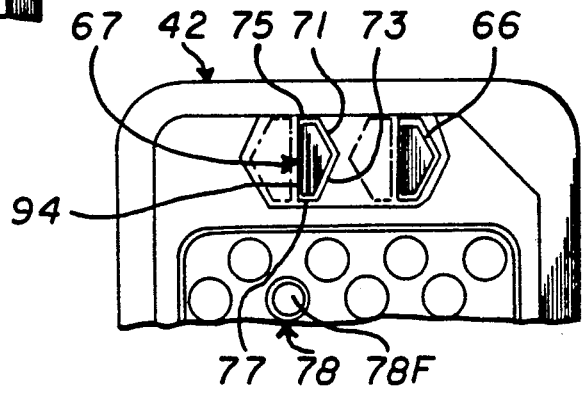
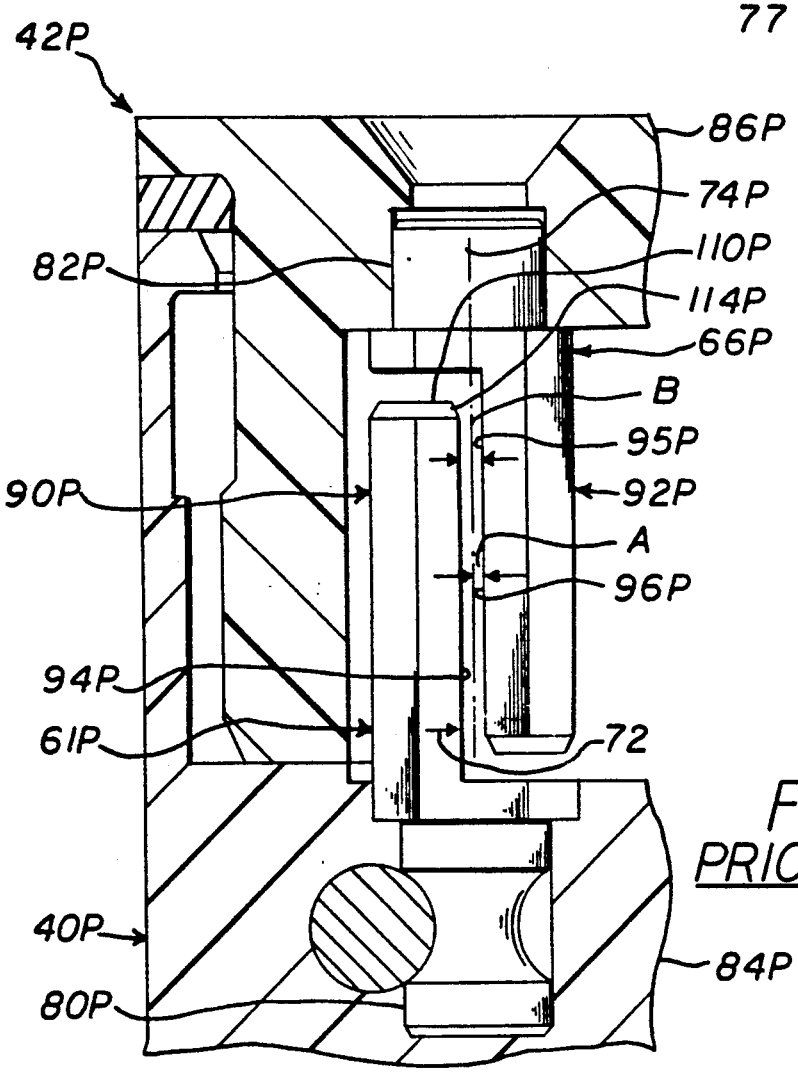
FIG. 5
PRIOR ART

POLARIZING KEY PERMITTING CONNECTOR DISPLACEMENT

BACKGROUND OF THE INVENTION

High quality electronics equipment, such as for military applications, is often designed around modules. Each module consists of a metal heat sink plate, circuit boards laminated to opposite sides of the plate, and a connector at one end of the plate. Several of such modules or panels are installed in a rack by inserting projecting upper and lower portions of the heat sink plate into upper and lower groove-like tracks of the rack and sliding the module into place. As the module is slid into place, the multiple contacts of the module connector mate with corresponding contacts of a rack connector. Finally, clamps are operated to tightly clamp the projecting upper and lower ends of the plate against a side of the track which forms a cold plate that removes heat from the module.

The module and rack connectors have interfitting polarizing keys that allow only one of several modules to be fully inserted into a particular position in the rack. If the wrong module is inserted at a rack position, the equipment will not operate properly, and in fact components of the module may be damaged by subjecting them to excessive voltages. One approach to the use of polarizing keys, is to use identical keys, but to establish the polarization of each key by its rotational orientation. Such polarizing keys have traditionally had hexagonal or other polygonal shapes, with each key of a mating pair cut in half so that two interfitting keys form a hexagon. The keys are formed so there is a slight gap between them to allow for manufacturing tolerances. Such keys have long been used in rack-and-panel electronic circuit apparatus. However, this type of key is difficult to use for a connector designed for heat sink clamping.

Where two mating keys, that are each almost half of a hexagon, are used in heat sink clamping, the gap between the keys must be increased. This is because one key may be moved slightly closer to the other during clamping of the heat sink plate. Such movement of the plate during clamping is small, such as 0.010 inch, but is significant where small keys are used. Where the gap between keys is increased, this reduces the contact area between two nonmating polarizing keys. Such reduced contact area between mismated keys, could allow a module that was placed in the wrong rack position, to be accidentally fully inserted so the connectors on the module mate with those on the rack, resulting in misfunction and possible damage. A polarizing key design which maintained a clearance between keys to allow for key displacement during heat sink clamping, but which provided large interference between mismated keys, would be of considerable value.

SUMMARY OF THE INVENTION

In accordance with one embodiment of the present invention, a key system is provided for polarizing electrical connectors, which provides a considerable gap between keys to enable sideward displacement of one fully mated key with respect to the other, while providing large interference between mismating keys. A first key has an elongated keying portion extending in a mating direction, with an interfitting side which can lie opposite the interfitting side of a mating similar second key. The interfitting side of each key includes forward and rearward parts, wherein the forward part first encounters the mating key as they approach each one another prior to mating. The rearward part of the interfitting side is instepped with respect to the forward part of the interfitting side. As a result, there is a very narrow gap between the forward parts of the interfitting sides as the keys start to mate, to provide a large area of interference between mismated keys. However, once the keys are fully mated, when the rearward part of each interfitting side of a key lies opposite the forward interfitting side of the other key, there is a larger gap between the keys to allow substantial sideward movement of one key with respect to the other.

The keys are useful in an electronic circuit apparatus of the type which includes modules that can slide along tracks of a rack until connectors on the modules mate with connectors at the ends of the tracks of the rack. Keys on the module connector and the rack connector assure that only the proper module is inserted in the proper rack position. The polarizing keys provide a large area of contact between mismated keys, while still allowing a heat sink plate on each module to be shifted slightly while it is being clamped against a cold plate of the rack.

Each keying portion of a key preferably has a cross section which is slightly less than half of a hexagon, including first and second hexagon sides and slightly less than half of third and fourth hexagon sides. The length of the surface along the third and fourth hexagon sides is greater at the forward part of each keying portion of a key than at the rearward part of a key.

The novel features of the invention are set forth with particularity in the appended claims. The invention will be best understood from the following description when read in conjunction with the accompanying drawings.

BRIEF DESCRIPTION OF THE DRAWINGS

FIG. 1 is an exploded partial perspective view of an electronic circuit apparatus which uses polarizing keys of the present invention.

FIG. 2 is a partial front elevation view of the apparatus of FIG. 1.

FIG. 3 is a partial front view of the module connector of the module of FIG. 1.

FIG. 4 is a partial front elevation view of the rack connector of the rack of FIG. 1.

FIG. 5 is a partial sectional view of a prior art connector apparatus, showing the keys of two connectors in their fully mated positions.

FIG. 9 is a partial exploded and perspective view of a connector of the type shown in FIG. 3, but with a different key polarization.

DESCRIPTION OF THE PREFERRED EMBODIMENT

Figure 6:
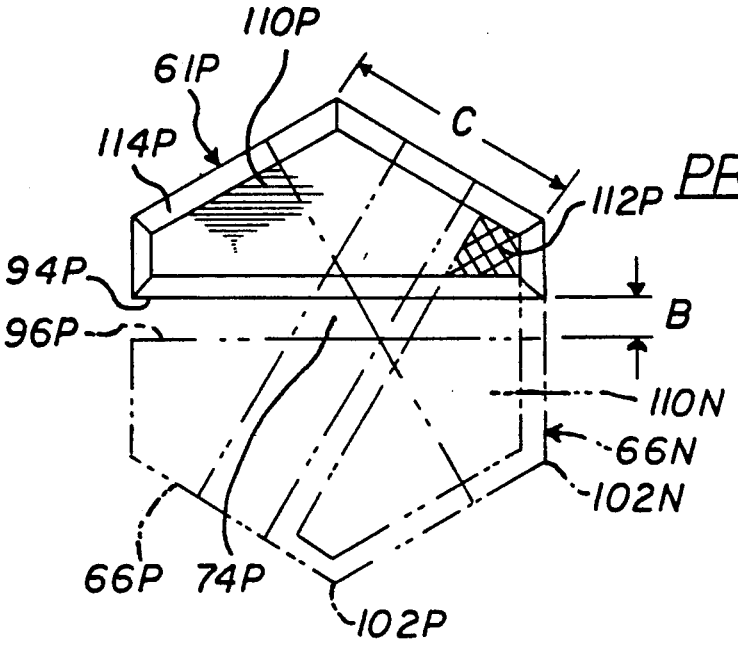
FIG. 6 PRIOR ART
FIG. 6 is a front elevation view of the keying portion of one of the prior art keys of FIG. 1, and indicating the interference area with a mismated key under worse case conditions.

FIG. 1 illustrates an electronic circuit apparatus 10 which includes a rack 12 having a plurality of module-receiving tracks, including upper and lower tracks 14, 16. A module 20 includes a heat sink plate 22 with upper and lower parts 24, 26 which can slide along the tracks 14, 16 into the rack. The module includes a pair of circuits 30, 32, each having components 34 to be connected to circuitry of the rack, such as a mother board 36. The module has a module plug connector 40 which connects to a rack receptacle connector 42 as the module is inserted in a mating direction 44 deep into the rack. When the module has been fully inserted in the mating direction, clamps 46, 48, such as of the wedge lock type, are operated to shift the upper and lower parts 24, 26 of the module heat sink plate sidewardly, so they press firmly against side walls 50, 52 of the tracks. The side walls may be referred to as cold plates, which are maintained at a low temperature so they cool the module heat sink plate 22 to cool the components of the module.

Each of the connectors 40, 42 have polarizing keys, with the module keys shown at 61–64 and the rack connector keys shown at 66–69. As the connectors approach each other, and prior to mating of their multiple contacts, corresponding keys such as 61 and 66 of the connector begin to mate. If the keys of the two connectors are mismatched, or mismated, which indicates that the module has been inserted into the wrong tracks, the front ends of the keys abut one another and prevent the connectors from mating. Thus, the keys prevent a module from being inserted into a wrong position, where its presence could cause the apparatus to malfunction, and which could even cause damage to the components of the module as where excessive voltages are applied to certain module components.

FIGS. 3 and 4 show portions of the two connectors 40, 42, showing the front surfaces of their keys 61–62 and 66–67. When the two modules are mated, a pair of mating keys such as 61 and 66 lie beside one another, with FIG. 3 showing key 66 lying in a space 65 beside key 61. The front end of each key is slightly less than half of a hexagon, with first and second key surfaces 71, 73 (FIG. 4) forming two sides of a hexagon, third and fourth key surfaces 75, 77 forming slightly less than half of a hexagon side, and an interfitting key side 94 connecting the third and fourth surfaces. When the keys mate they form a complete hexagon, with a small gap 70 (FIG. 3) between the keys. The small gap is useful to allow the keys to mate or interfit despite manufacturing tolerances. The small gap 70 also allows each module key such as 61 to shift slightly in a clamping direction 72 when the module and the module connector 40 thereon are shifted slightly during clamping of the module heat sink plate. Each key has an axis 74 lying at the center of the hexagon of which the key is part. The keys can have any one of six different orientations about the axis 74, and each key will mate only with another key which is in a particular one of six different orientations. The connectors have pin and socket contacts 76, 78 with front ends 76*f*, 78*f* which do not begin to mate until the keys of the two connectors are already partially mated. The socket contacts are free floating so they can shift slightly with the pin contacts during clamping.

FIG. 5 shows a pair of prior art keys 61P, 66P of prior art connectors 40P, 42P. Each key had a mounting portion 80P, 82P mounted in a connector body 84P, 86P, and had a keying portion 90P, 92P. Each keying portion had an interfitting key side 94P, 96P, with the interfitting sides lying slightly spaced from one another. Each interfitting key side such as 96P was spaced a distance A from the key axis 74P, and the interfitting sides of the two keys were spaced a distance B apart which was equal to twice A. The gap 95P must be large enough to assure that mating keys can interfit as shown, despite manufacturing tolerances; however, the gap width B was larger than required for this purpose, because it had to be large enough to allow the module connector 40P to be shifted in the clamping direction 72 towards the other key. The consequence of having a large gap 95P between keys, is that it results in only a small interference between mismating keys.

FIG. 6 is a top or front view of the module key 61P, and shows how there is interference with a mismating key 66N. A properly mating key would be at the position 66P, but the mismating key 66 is rotated 60° about the key axis 74P, so its center point has been rotated from the position 102P to the position 102N. In that case, the top surfaces 110P, 110N of the two keys make contact in the area indicated at 112P. It may be noted that the top or front surface of each key has a chamfer 114P of a width of 0.004 inch or 4 mils (each mil equals 0.001 inch) surrounding the top or front surface 110P of the key. The top surface contact area 112P is relatively small. Commonly used keys are of a size wherein the opposite surfaces are spaced apart by 100 mils, so each side of the hexagon has a length C of 57.75 mils. The module shifts a distance of about 10 mils when it is clamped. The gap distance B between mating interfitting key sides 94P, 96P previously has been about 20 mils, to allow for sideward shifting of one key by 10 mils and to allow for combined tolerances of 10 mils. In this example, the top surface contact area 112P is $0.116mm^2$ ($1.8x\ 10\times4$ $inch^2$).

With a contact area 112P of only $0.116mm^2$, damage to the keys and unintended mating can occur. Stainless steel, which is the usual material for such keys, has a Brinell hardness of about $150Kg/mm^2$. When an inserting force of 17.4Kg (38.39 pounds) is applied, bearing failure of the stainless steel can occur at the contact area 112P. Especially where injection devices are used to fully insert the modules, there is considerable danger of key failure and complete insertion of a module in the wrong position.

Figure 7:
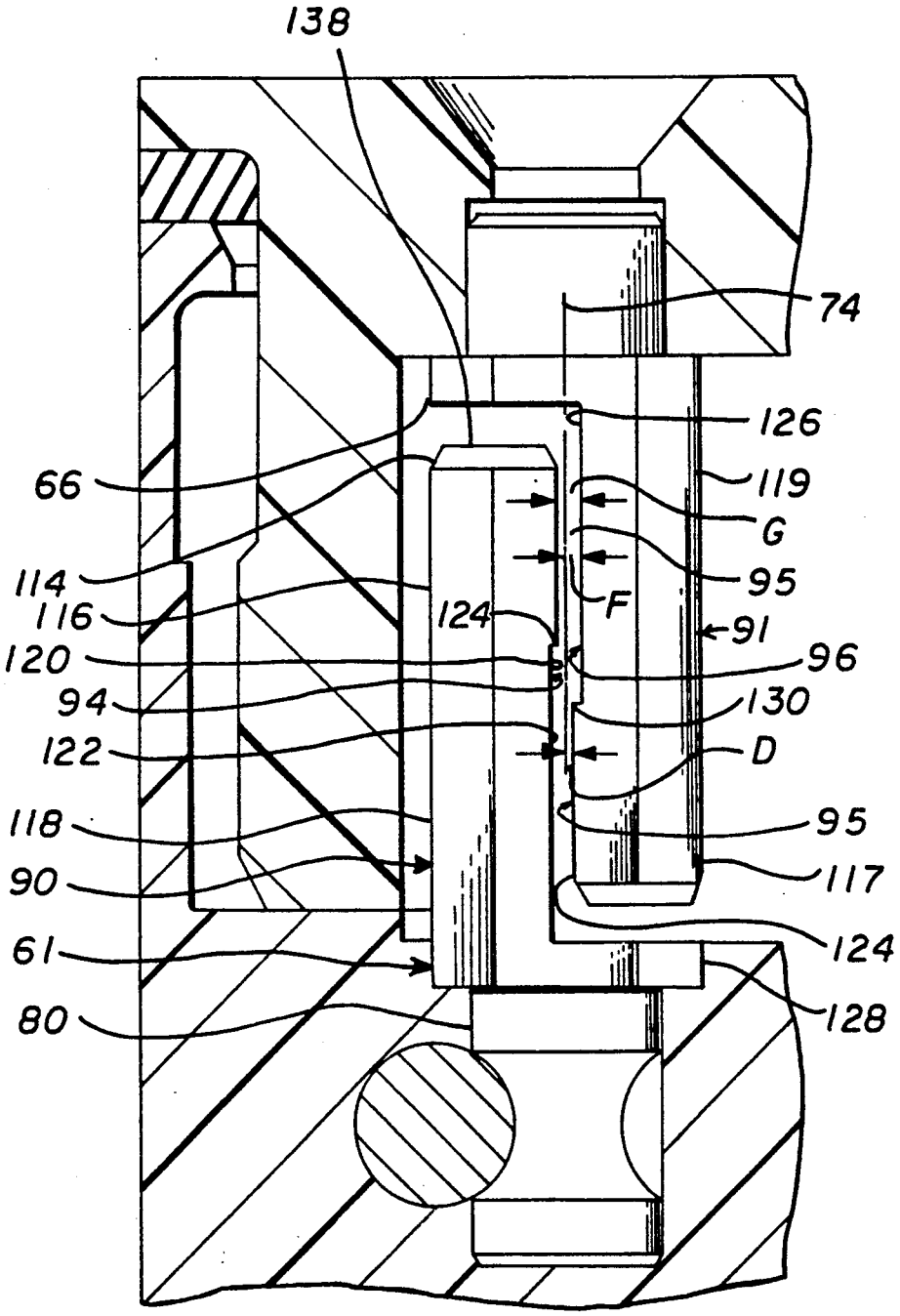
FIG. 7 is a partial sectional view showing the keys of the connectors of FIGS. 3 and 4 in fully mated positions.

FIG. 7 illustrates details of keys 61, 66 of the present invention which have been fully mated. The keys provide a sufficient gap 95 to allow for tolerances in manufacture and sideward shifting of one key relative to the other, while providing a much larger top surface contact area between mismating keys. The module key 61 has a mounting portion 80, and also has a keying portion 90 with forward and rearward parts 116, 118. The key has an interfitting key side 94 with forward and rearward parts 120, 122. The forward part 120 lies close to the key axis 74, while the rearward part 122 is indented or instepped from the forward part and lies further from the key axis. A step 124 separates the forward and rearward parts of the interfitting key side 94 and of the keying portion 90. The rack key 66 is similarly constructed, with its interfitting key side 96 having a similar forward part 124 and instepped rearward part 126, and with its keying portion 91 having forward and rearward parts 117, 119 divided at a step 130. The mounting portion of each key includes a full hexagonal part 128 that fixes the rotational position of the key.

In the arrangement of FIG. 7, as the keys approach one another for mating, the forward parts 120, 124 of the mating keys pass closely across one another. However, when the steps 124, 130 pass one another, then the forward part such as 124 of a key lies opposite the instepped rearward part 122 of the opposite mating key. Since the rearward part 122 lies further from the key axis, there is a considerable space or gap 95 between the keys.

Figure 8:
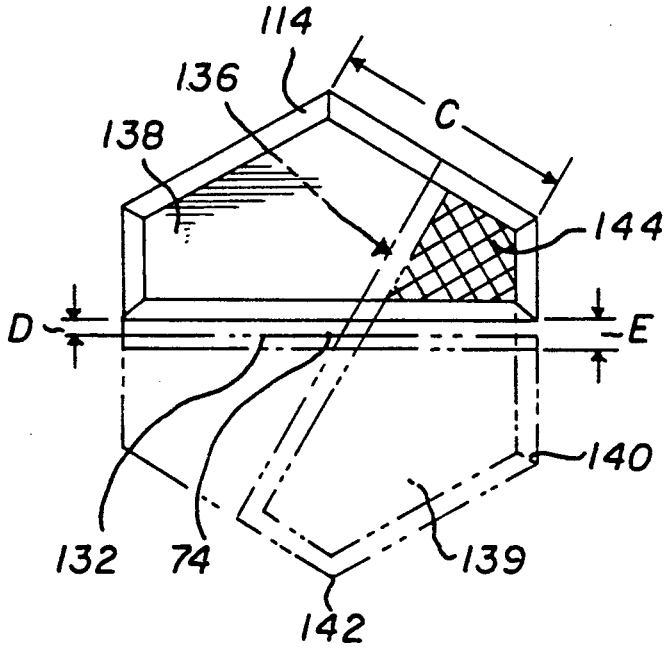
FIG. 8 is a front elevation view of one of the keys of FIG. 7, and showing the interference area produced by mismated keys under a worse case condition.

In one example, where each key is part of a hexagon, as shown in FIG. 8, with each side of the hexagon having a length C of 57.75 mils (one mil equals 0.001 inch) the forward part of each key is spaced a distance D of 4 mils from the key axis 74 (all dimensions are plus or minus one mil). The forward key part is also spaced 4 mils from an imaginary center plane 132 that passes through the key axis and that lies halfway between the keys. The distance E between the forward parts of the two keys, at the beginning of mating, is 8 mils. The rearward part of each key is spaced a distance F of 12 mils from the key axis. Accordingly, when the keys are fully mated, the gap 95 between pins has a length G of 16 mils. The gap distance G of 16 mils is large enough to allow for manufacturing tolerances and still allow shifting of one of the pins towards the other by 10 mils during heat sink clamping. The width of the chamfer 114 is 4 mils.

The major advantage of the arrangement of FIG. 7, is that the forward parts 120, 124 of the two keys lie only 8 mils apart during the beginning of mating. If a mismating key 136 (FIG. 8) is installed, whose center point 140 is angled by only 60° from the center point 142 of a properly mating key, then the top surfaces 138, 139 of the keys interfere in an area 144 which is considerable. In the above example where the length C of each hexagon side is 57.75 mils, and the gap distance E of the front parts is 8 mils, the top surface contact area 144 is $0.348mm^2$ ($5.4x\ 10\times4\ inch^2$). For stainless steel keys with a Brinell hardness of $150Kg/mm^2$ this contact area will sustain a load of 115 pounds before bearing failure at the contact area. This is sufficient to cause a technician to understand that the connectors are incorrectly polarized. In the prior art key arrangement of FIG. 6, the contact area 112P is $0.116mm^2$ for a gap width B of 20 mils and $0.177mm^2$ for a gap width B of 16 mils, or about half the contact area 144 (FIG. 8) for the present key arrangement.

FIG. 9 is a perspective view of a pair of keys 61*x*, 62*x* of the same type as the keys 61, 62, but rotated 180° about the key axis 74. It can be seen that the third and fourth surfaces 75, 77 of the key are longer at the forward key part 116 than at the rearward key part 118 (in lateral directions L that are perpendicular to a forward direction F). The keying portion 90 of each key extends in a forward direction F from the mounting portion 80.

Thus, the invention provides a polarizing electrical connector key which can mate with another similar second key, which provides a considerable gap between the fully mated keys to allow one fully mated key to shift towards the other, while providing a considerable top surface contact area between mismating keys. This is accomplished by constructing each key with an elongated keying portion having an interfitting side with a rearward part that is indented or instepped with respect to the forward part thereof. As a result, when two mating keys start to mate, there is only a small gap between the forward parts of their interfitting surfaces, but when they are fully mated there is a large gap between the forward part surface of one key and the rearward part surface of the other key. On the other hand, if there is an attempt to mate two mismating keys, the front or top surfaces of the keys will abut one another over a considerable area, to reliably prevent mismating. The keys are especially useful for connectors on racks which mate with connectors on modules, wherein each module includes a heat sink plate that is shifted slightly during clamping of the heat sink plate against a cold plate of the rack.

Although particular embodiments of the invention have been described and illustrated herein, it is recognized that modifications and variations may readily occur to those skilled in the art, and consequently it is intended that the claims be interpreted to cover such modifications and equivalents.

I claim:

1. In a connector system which includes plug and receptacle connectors with contacts having front ends that mate when the connectors move in a mating direction towards each other, each connector having a key which is polarized by its rotational orientation about a key axis extending in said mating direction, wherein each of said keys lies on one side of said key axis and a pair of mating keys lie on opposite sides of said key axis when said connectors are mated, and wherein the connectors and said mating keys can be shifted perpendicular to said mating direction after said connectors are mated, the improvement wherein:

each of said keys has forward and rearward parts that are positioned so the forward part of each key lies opposite the rearward part of the other key when the connectors are fully mated, the forward part of each key lying closer to the key axis than the rearward part of the same key.

2. The improvement described in claim 1 wherein:

the forward and rearward parts of each of said keys forms approximately one half of a hexagon, including first and second key surfaces forming adjacent sides of the hexagon and third and fourth surfaces forming less than half of third and fourth sides of the hexagon, and each key forms an interfitting key side connecting said third and fourth key surfaces with the forward part of each key having longer third and fourth surfaces than the rearward part of the key.

3. A connector arrangement comprising:

first and second electrical connectors which have contacts that mate when the connectors are moved in forward directions toward each other, said first connector having a first key mounted thereon and said second connector having a second key mounted thereon;

each of said keys has a keying portion with an interfitting side which lies opposite the interfitting side of the other key with an imaginary plane between said interfitting sides, when said connectors are mated, and each interfitting side has forward and rearward parts with each rearward part being indented with respect to the forward part, and with each forward part lying closer to said plane than the rearward part.

4. The key described in claim 3 wherein:

said keying portion of said first key has a cross-section which is slightly less than half of a hexagon, and includes first and second key surfaces lying on the adjacent sides of the hexagon and third and fourth key surfaces each comprising less than half of third and fourth sides of the hexagon that lie respectively adjacent to said first and second sides, and said interfitting side comprises a line connecting said third and fourth surfaces at cross-sections of said keying portion, with the third and fourth surfaces being longer in a lateral direction that is perpendicular to said forward direction, along said forward part of said interfitting side than along said rearward part of said interfitting side.

5. In an electronic circuit apparatus which includes a rack having a plurality of module-receiving tracks, a multi-contact rack connector at an end of each track, a cold plate beside the track, and a clamping device for clamping a module portion lying in the track against the cold plate, and wherein the apparatus also includes a plurality of modules that each comprises a heat sink plate that can slide along the track, at least one circuit with electronic components mounted on said plate, and a multi-contact module connector mounted on said plate and having contacts coupled to said module components, and wherein said rack connector has a polarizing key that mates with a corresponding polarizing key of only a selected one of said modules, and wherein each polarizing key has an elongated keying position with an interfitting side that extends in said mating direction and each connector has a space adjacent to the interfitting side of its key for receiving the keying portion of the key of the corresponding connector, the improvement wherein:

the keying portion of each of said keys has a forward part which is closest to a key of a mating connector before the connectors begin to mate, and has a rear part, with the interfitting side of the rear part of a key being instepped with respect to the front part of that key.

6. The improvement described in claim 5 wherein:

said keying portion of said first key has a cross-section which is slightly less than half of a hexagon, and includes first and second surfaces lying on the adjacent sides of the hexagon and third and fourth surfaces each comprising less than half of third and fourth sides of the hexagon that lie respectively adjacent to said first and second sides, and said interfitting side comprises a line connecting said third and fourth surfaces at cross-sections of said keying portion, with the third and fourth surfaces being longer, in a lateral direction which is perpendicular to said mating direction, along said forward part of said interfitting side than along said rearward part thereof.

* * * * *